US008931664B2

(12) United States Patent
Foster

(10) Patent No.: US 8,931,664 B2
(45) Date of Patent: Jan. 13, 2015

(54) SINGLE USE DISPENSER PACKAGE

(75) Inventor: Diana Foster, Potomac, MD (US)

(73) Assignee: Wave Creative Products Inc., Pompano Beach, FL (US)

( * ) Notice: Subject to any disclaimer, the term of this patent is extended or adjusted under 35 U.S.C. 154(b) by 110 days.

(21) Appl. No.: 13/560,378

(22) Filed: Jul. 27, 2012

(65) Prior Publication Data

US 2013/0026183 A1 Jan. 31, 2013

Related U.S. Application Data

(60) Provisional application No. 61/512,024, filed on Jul. 27, 2011.

(51) Int. Cl.
*B65D 35/00* (2006.01)
*B65D 77/04* (2006.01)
*B65D 35/08* (2006.01)

(52) U.S. Cl.
CPC ..... *B65D 77/0473* (2013.01); *B65D 35/08* (2013.01)
USPC ..... 222/107; 222/157; 222/158; 222/491; 222/527; 222/529

(58) Field of Classification Search
CPC ..... B65D 35/02; B65D 35/04; B65D 35/08; B65D 35/12; B65D 25/42; B65D 25/40; B65D 25/46; B65D 47/065; B65D 47/2018; B29L 2023/20
USPC ..... 222/92, 107, 157–159, 527–530, 222/213–215, 491
See application file for complete search history.

(56) References Cited

U.S. PATENT DOCUMENTS

| | | | | |
|---|---|---|---|---|
| 2,390,822 | A * | 12/1945 | Wren | 222/572 |
| 3,224,640 | A * | 12/1965 | Schneider et al. | 222/107 |
| 3,815,794 | A * | 6/1974 | Carlisle | 222/491 |
| 4,163,509 | A * | 8/1979 | Amneus | 222/95 |
| 4,640,425 | A * | 2/1987 | Cabernoch | 215/11.6 |
| 5,407,107 | A * | 4/1995 | Smith | 222/548 |
| 6,244,468 | B1 * | 6/2001 | Farmer et al. | 222/107 |
| 7,143,910 | B2 * | 12/2006 | Redmond | 222/107 |
| 7,765,987 | B2 * | 8/2010 | Steinbauer et al. | 123/490 |
| 8,500,707 | B2 * | 8/2013 | Murray | 604/332 |

* cited by examiner

*Primary Examiner* — Frederick C Nicolas
(74) *Attorney, Agent, or Firm* — Robert M. Downey, P.A.

(57) ABSTRACT

A single use dispenser package is configured and sized for storing and dispensing a single serving of a liquid or viscous product. An elongated stem on one end of the dispenser package is provided, having an aperture adaptable for dispensing a variety of products, ranging from liquid to considerably viscous products. To prevent inadvertent emission of the product, and in order to keep the opening of the dispenser package closed and sanitary prior to use, a portion of the relevant end of the dispenser package is folded over on itself and sealed with a food grade adhesive. The food grade adhesive seal may be easily broken by the user for dispensing the liquid or viscous product. The single use dispenser packages are tube-shaped to allow for easy squeezing and emission of the product out of the aperture.

9 Claims, 5 Drawing Sheets

SINGLE USE DISPENSER PACKAGE

This application claims the benefit of U.S. Provisional Patent Application Ser. No. 61/512,024 filed on Jul. 27, 2011.

BACKGROUND OF THE INVENTION

1. Field of the Invention

The present invention relates to product dispensers and, more particularly, a single use dispenser package for dispensing products such as toothpaste, shampoo, liquid cosmetics, medicinal liquids and creams, and food items.

2. Discussion of the Related Art

Single use and single serving products have been in use for a several years and provide a level of flexibility and convenience for users. While a number of single use products are widely used in the food industry, such as packets of ketchup, mustard and other condiments, relatively few single use products are widely used in other product markets, such as toothpaste, mouthwash, shampoo, and liquid cosmetics.

An example of a single use product delivery package in the above-identified product markets is provided in U.S. Pat. No. 6,845,883 to Pieri, which discloses a toothpaste dispenser for monitoring a child's toothpaste usage that includes an elongated strip having a plurality of one time use sachets, each including a quantity of toothpaste suitable for a single use. While the dispenser disclosed in the '883 patent is useful for its intended purpose, it does not provide for clean and easy emission of a product, which makes the dispenser rather unusable.

Another example of a single use product delivery package is disclosed in U.S. Pat. No. 6,557,731 to Lyon et al. The '731 patent provides a single use glue dispensing package including one end having a perforated edge for tearing off, thereby allowing the glue to be removed therefrom. Requiring perforated edges to be torn off can result in an amount of the contained product being inadvertently emitted, however, as the user must grip the opposite side of the glue dispensing package when tearing off the perforated edge. Such a delivery package would be highly ineffectual for containing liquid products.

Therefore, there remains a need for a single use dispenser package that provides easy and sanitary delivery of a product and which is adaptable for dispensing both liquid and viscous products.

OBJECTS AND ADVANTAGES OF THE INVENTION

Considering the foregoing, it is a primary object of the present invention to provide a single use dispenser package that is adaptable for dispensing both liquid and viscous products.

It is a further object of the present invention to provide a single use dispenser package that allows for sanitary dispensing of a product, wherein delivery of the product does not require the package to physically contact the receptacle receiving the product.

It is a further object of the present invention to provide a single use dispenser package that is easy to use.

It is a further object of the present invention to provide a single use dispenser package that can be easily opened prior to dispensing the product and will not result in inadvertent emission of the liquid or viscous product contained therein.

It is still a further object of the present invention to provide a single use dispenser package that is inexpensive to manufacture.

It is yet a further object of the present invention to provide a single use dispenser package that includes measuring markings for readily identifying the quantity of liquid or viscous product contained therein.

These and other objects and advantages of the present invention are readily apparent with reference to the detailed description and accompanying drawings.

SUMMARY OF THE INVENTION

The present invention is directed to a single use dispenser package that is configured and sized for dispensing a single serving of a liquid or viscous product. Each single use dispenser package is formed of polypropylene, a well known packaging material. An elongated stem on one end of the dispenser package is provided, having an aperture adaptable for dispensing a variety of products, ranging from liquid to considerably viscous products. To prevent inadvertent emission of the product, and in order to keep the opening of the dispenser package closed and sanitary prior to use, a portion of the relevant end of the dispenser package is folded over on itself and sealed with a food grade adhesive. The food grade adhesive seal may be easily broken by the user for dispensing the liquid or viscous product. The single use dispenser packages are tube-shaped to allow for easy squeezing and emission of the product out of the aperture.

BRIEF DESCRIPTION OF THE DRAWINGS

For a fuller understanding of the nature of the present invention, reference should be made to the following detailed description taken in conjunction with the accompanying drawings in which.

Like reference numerals refer to like parts throughout the several views of the drawings.

DETAILED DESCRIPTION OF THE PREFERRED EMBODIMENT

Figure 1:
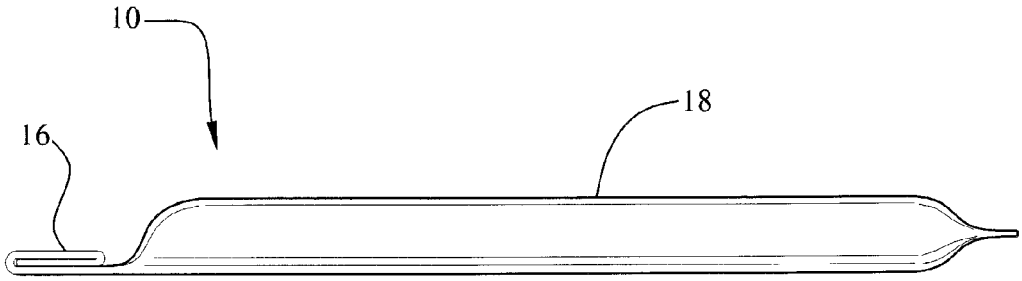
FIG. 1 is a front side view of the single use dispenser package of the present invention.
Figure 2:
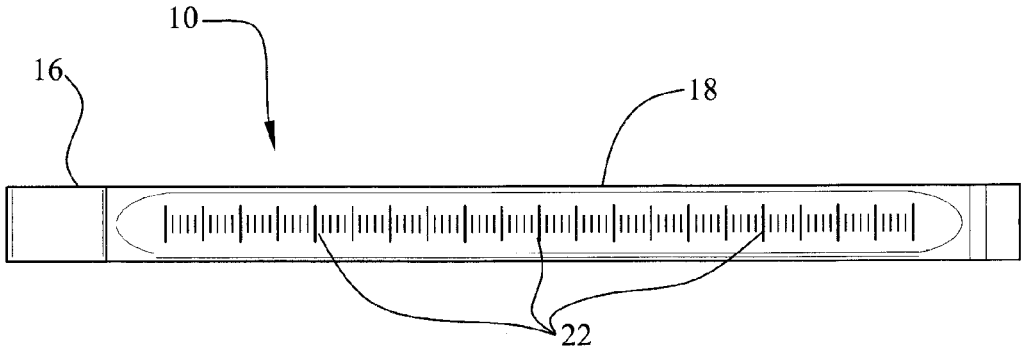
FIG. 2 is a top side view of the single use dispenser package of the present invention.
Figure 3A:
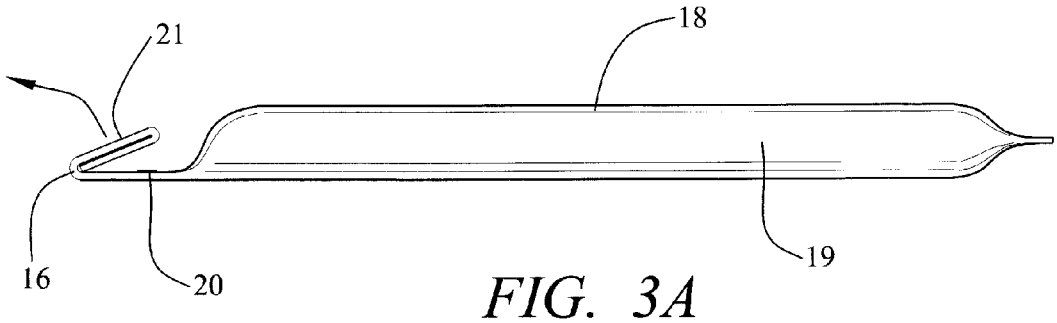
FIG. 3 is a side view of the single use dispenser package of the present invention, shown in cross-section, illustrating the process for opening a single use dispenser package.
Figure 3B:
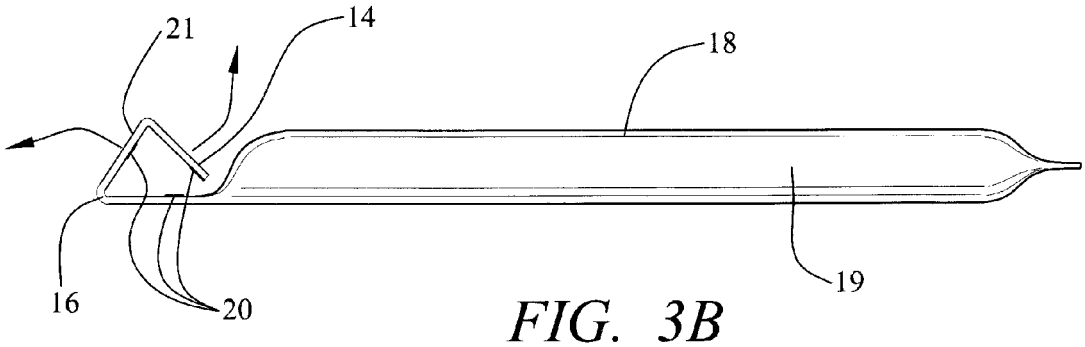

Referring to the several views of the drawings, and initially FIGS. 1-3, the single use dispenser package for storing and dispensing liquid and viscous products is shown and is generally indicated as 10.

A single use dispenser package 10 is formed of polypropylene in a tube-shaped form, as seen in FIGS. 1-3. Each single use dispenser package 10 is sized and configured for containing a measured quantity amounting to a single serving of a liquid or viscous product 12 that may be emitted via an aperture 14 located on an elongated stem 16 in communication with the container 18 of the dispenser package 10. The liquid or viscous product 12 is stored in an interior chamber 19 and emitted therefrom by squeezing the container 18 of the dispenser package 10, thereby forcing the product 12 stored within the interior chamber 19 into the interior channel 21 extending between the interior chamber 19 and the aperture 14. The aperture 14 preferably extends the entire width of the elongated stem 16 for easy and sanitary emission of the product 12.

In a preferred embodiment, the elongated stem 16 of the dispenser package 10 is folded over on itself, preferably two times as illustrated in FIG. 3, thereby pinching closed the interior channel 21 and preventing the liquid or viscous product 12 from being inadvertently emitted through the aperture 14. A food grade adhesive 20 is applied to portions of the elongated stem 16 of the of the dispenser package 10 to releasably seal the folded segments of the elongated stem 16, thereby ensuring the product 12 will not be emitted via the aperture 14 prior to its intended use. The seal produced by the food grade adhesive 20 requires little force to be broken by the user for dispensing the liquid or viscous product 12.

In a preferred embodiment of the dispenser package 10, a measuring marker 22 or a sequence of measuring markings 22 is included on the main body 18, wherein the product 12 is visible through the main body 18, making the amount of product 12 readily identifiable to a user. Such measuring markings 22 would be particularly desirable where the dispenser package 10 contains an amount of liquid or viscous medicine.

Figure 4:
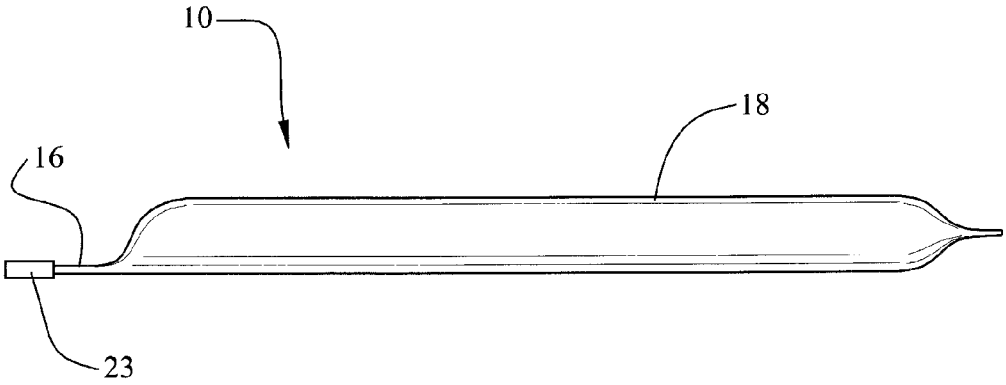
FIG. 4 is a front side view of an alternative embodiment of the single use dispenser package of the present invention.

Referring to FIG. 4, an alternative embodiment of the single use dispenser package 10 is shown, wherein the elongated stem 16 is not foldable and includes a cap, such as a breakaway cap 23, for preventing inadvertent emission of the product 12. The breakaway cap 23 requires little force from a user to be removed to reveal the aperture 14 for dispensing of the product 12. Other caps, such as a screw-on cap (not pictured) may be used as well.

Figure 5:
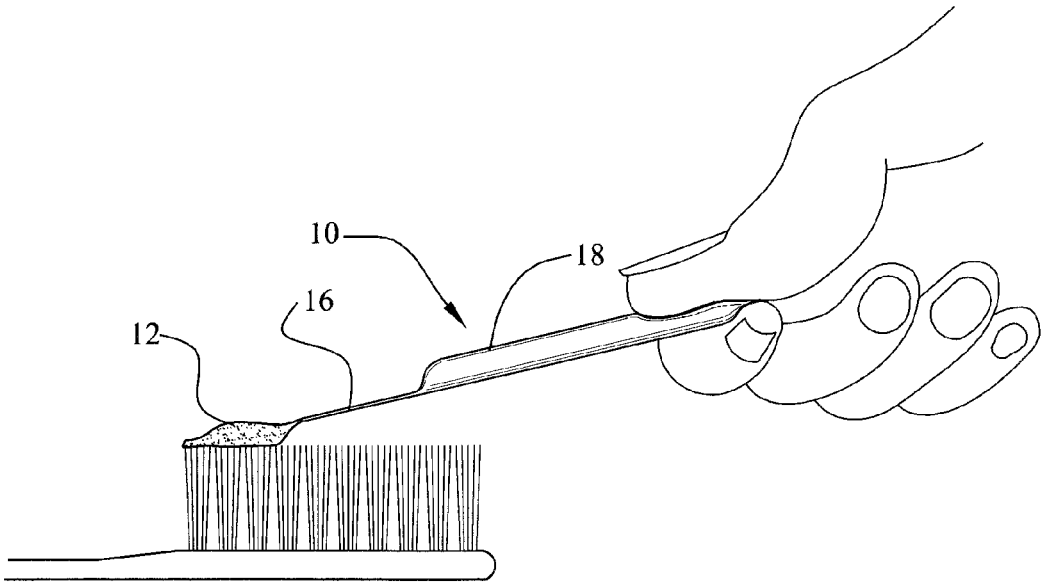
FIG. 5 is a side view of the single use dispenser package, shown in accordance with a preferred embodiment, wherein toothpaste is dispensed from the single use dispenser package.

As shown in FIG. 5, the aperture 14 is sized and positioned to allow the product 12 to be emitted from the dispenser package 10 without requiring that the dispenser package 10 come into contact with the object intended to receive the product 12, such as a toothbrush, as illustrated in FIG. 5. The small size of the interior channel 21 and aperture 14 relative to the interior chamber 19 makes squeezing the product 12 out of the aperture 14 easy and does not require that the user's fingers get close to the product 12 or aperture 14. The small size of the interior channel 21 and aperture 14 relative to the interior chamber 19 further makes the dispenser package 10 useful for containing a range of products, such as toothpaste, mouthwash, shampoo, medicinal liquids and creams, and food items.

Figure 6:
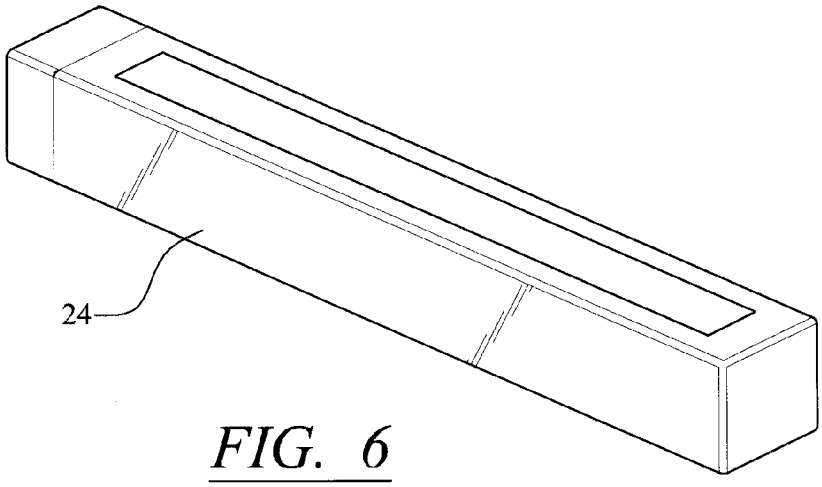
FIG. 6 is a perspective view of a single use cartridge for storing one single use dispenser package of the present invention.
Figure 7:
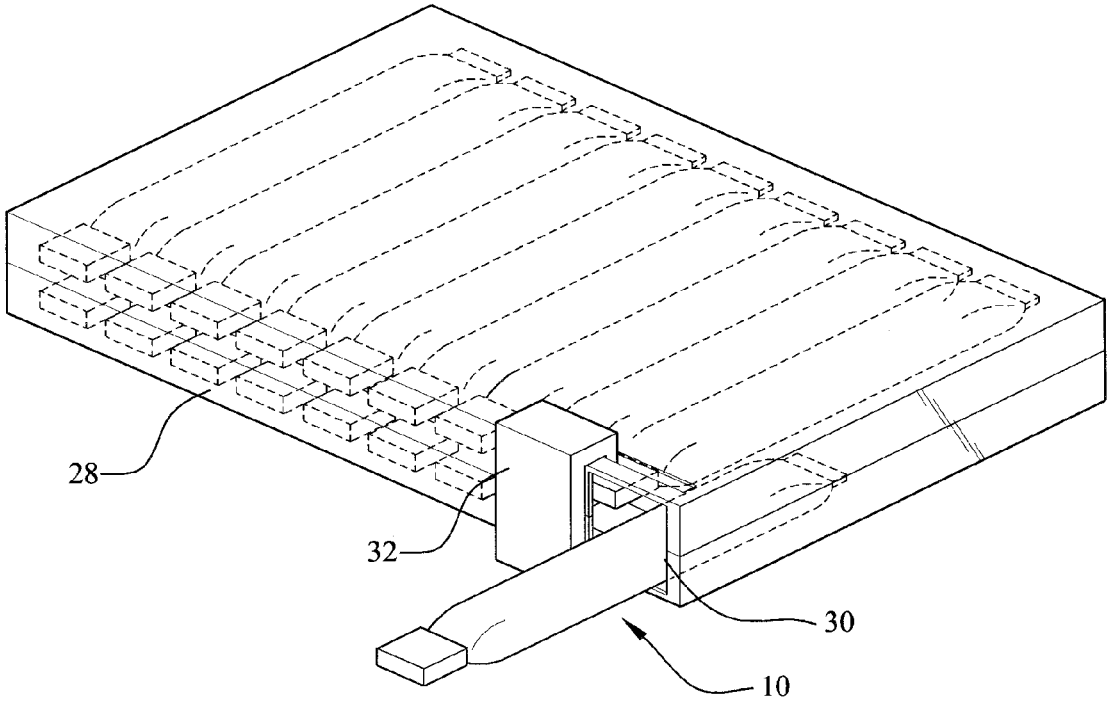
FIG. 7 is a perspective view of a dispenser cartridge for storing multiple single use dispenser packages.
Figure 8:
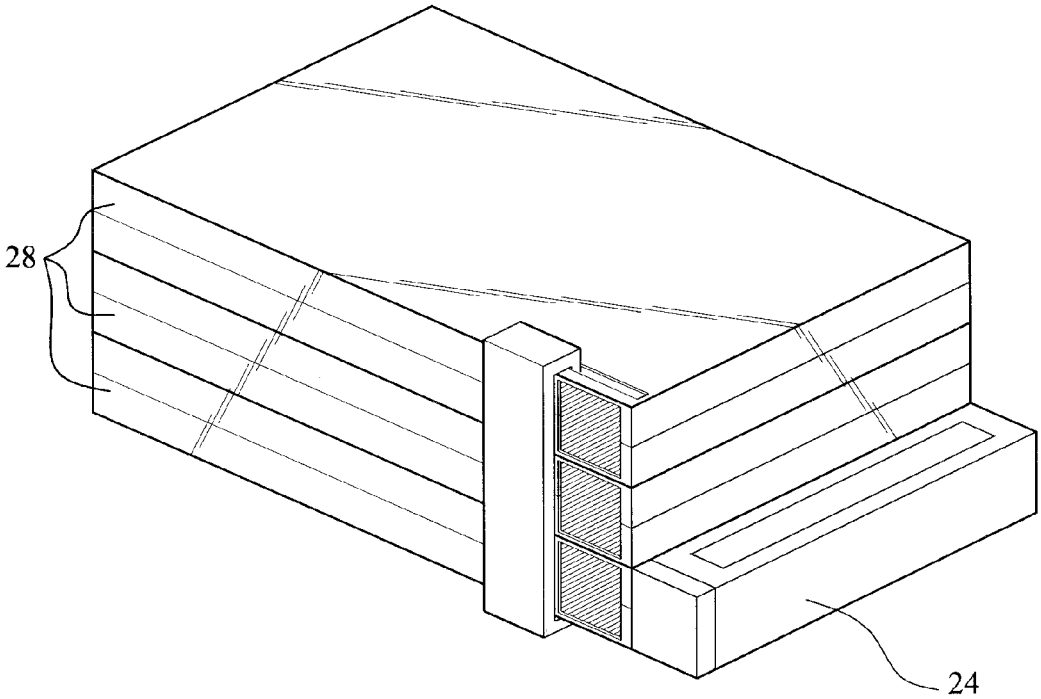
FIG. 8 is a perspective view of multiple dispenser cartridges for storing multiple single use dispenser packages in connection with single use dispenser cartridges for storing one single use dispenser packages.

A single use cartridge 24 having a removable top 26 is provided for storing a single use dispenser package 10, as seen in FIG. 6. A cartridge 28 is provided for storing multiple dispenser packages 10, as shown in FIG. 7, wherein the dispenser packages 10 are accessible via an opening 30 on the cartridge 28. A sliding door 32 may be opened and closed for providing and restricting access to the opening 30, respectively. Referring to FIG. 8, a preferred method of packaging the single use dispenser packages 10 is shown, wherein multiple single use cartridges 24 may be packaged alongside cartridges 28 for convenient accessibility.

While the present invention has been shown and described in accordance with several preferred and practical embodiments thereof, it is recognized that departures from the instant disclosure are fully contemplated within the spirit and scope of the invention as defined in the following claims and as interpreted under the Doctrine of Equivalence.

What is claimed is:

1. A single use dispenser package for storing a serving of a viscous product, said single use dispenser package comprising:

a container formed from a single unitary wall structure extending from a first end to an opposite second end, and said first end being closed and said opposite second end including an aperture defining a dispensing outlet, and said unitary wall structure including a first portion surrounding an interior chamber and a second portion defining an elongate stem surrounding an interior channel extending in fluid flow communication between said interior chamber and said aperture at said opposite second end;

said interior chamber extending from said first end of said container and towards said opposite second end and terminating prior to said second end of said container;

said interior channel extending between said interior chamber and said aperture at said second end of said container;

said elongate stem being foldable, wherein at least one segment of said elongate stem is foldable onto another segment of said elongate stem, thereby pinching closed the interior channel and preventing passage of the viscous product;

a food grade adhesive for releasably sealing together the folded segments of said elongate stem for preventing release of the viscous product stored in unitary wall structure prior to use of said single use dispenser package;

said food grade adhesive being breakable by a user; and wherein squeezing said first portion of said unitary wall structure of said container forces the viscous product stored in the interior chamber through the interior channel and out of the aperture.

2. The single use dispenser package as recited in claim 1 wherein at least a portion of said container is transparent for viewing the viscous product stored therein.

3. The single use dispenser package as recited in claim 2 further comprising at least one measuring marker for indicating the amount of the viscous product stored within the interior chamber of said container.

4. The single use dispenser package as recited in claim 1 wherein said viscous product is toothpaste.

5. The single use dispenser package as recited in claim 1 wherein said viscous product is mouthwash.

6. The single use dispenser package as recited in claim 1 wherein said viscous product is shampoo.

7. The single use dispenser package as recited in claim 1 wherein said viscous product is medicine.

8. The single use dispenser package as recited in claim 1 wherein said viscous product is a food product.

9. The single use dispenser package as recited in claim 1 wherein said container and said elongate stem are made of polypropylene.

* * * * *